US006080689A

United States Patent [19]

Kanehisa

[11] Patent Number: 6,080,689

[45] **Date of Patent: *Jun. 27, 2000**

[54] WOVEN OR KNIT FABRICS MANUFACTURED USING YARN DYED RAW SILK

[75] Inventor: Keiichiro Kanehisa, Tankeno-gun, Japan

[73] Assignee: Sumitomo Corporation, Japan

[ * ] Notice: This patent is subject to a terminal disclaimer.

[21] Appl. No.: 09/133,053

[22] Filed: Aug. 12, 1998

Related U.S. Application Data

[62] Division of application No. 08/836,971, filed as application No. PCT/JP96/01019, Apr. 12, 1996, Pat. No. 5,849,040.

[30] Foreign Application Priority Data

Feb. 23, 1996 [JP] Japan ..... 8-061825

[51] Int. Cl.[7] ..... D03D 15/00

[52] U.S. Cl. ..... 442/187; 8/401; 8/917; 8/494; 442/209; 442/301; 442/307

[58] Field of Search ..... 442/187, 209, 442/301, 307

[56] References Cited

U.S. PATENT DOCUMENTS 1,366,705 1/1921 Rosenstock .
5,538,519 7/1996 Horiguchi et al. .
5,849,040 12/1998 Kanehisa .

FOREIGN PATENT DOCUMENTS 53-81788 7/1978 Japan .
59-192771 11/1984 Japan .
61-34274 2/1986 Japan .
61-34724 2/1986 Japan .
3-57205 8/1991 Japan .

*Primary Examiner*—Margaret Einsmann
*Attorney, Agent, or Firm*—Ostrager Chong Flaherty & Onofrio, P.C.

[57] ABSTRACT

A process is provided for manufacturing a high quality cloth having a width of 150 cm or any width in which likelihood of occurrence of defects such as color shading, rub marks, wrinkles and creases due to fabric dyeing method is eliminated and color fastness is enhanced.

A process for manufacturing a woven or knit fabric using yarn dyed silk comprises the steps of dyeing (step 3) sericin which covers the periphery of silk fibers and fibroin which is located inside thereof into the same color; making yarn dyed silk (step 4, 5) by doubling and twisting the dyed silk fibers; making a cloth (step 6) by weaving or knitting the yarn dyed silk; swelling (step 7) the yarn dyed silk which constitutes the cloth by dipping the cloth into hot water in a tub; and decomposing (step 8) sericin of the yarn dyed silk of the cloth with an enzyme in hot water in a tub.

25 Claims, 9 Drawing Sheets

| | WOVEN OR KNITTED FABRIC SILK OF THE PRESENT INVENTION | PRIOR ART SILK 100% FABRIC MADE BY FABRIC DYED SILK |
|---|---|---|
| KIND OF CLOTH | 150cm FABRIC FOR JAPANESE CLOTHES | 96-114cm FOR JAPANESE CLOTH |
| DEFECT OF QUALITY | NO DEFECTS ; SUITED TO CLOTH FOR HIGH GRADE CLOTHES | DEFECTS SUCH AS COLOR SHADE, CREASE, RUB MARK, WRINKLE |
| COLOR FASTNESS / SHRINKAGE | GOOD | NO GOOD |
| COLOR | SAME ( SOLID ) CHAMBRAY POSSIBLE | ONLY ONE COLOR |
| TWIST AND JACQUAURD PRODUCT | HARD TWIST POSSIBLE | IMPOSSIBLE |
| STRETCHING ABILITY | PRESENT | ABSENT |
| WATER REPELLENT TREATMENT | POSSIBLE | IMPOSSIBLE |

FIG.11

| | EXAMPLE 1 | EXAMPLE 2 | PRIOR ART FABRIC DYED SILK 100% FABRIC |
|---|---|---|---|
| CARBON ARC LIGHT TEST ( JTS L0842 ) SECOND EXPOSURE METHOD | DISCOLDING<br>8 GRADE | 8 GRADE | 3-4 GRADES |
| ABRASION TEST ( JIS L0849 ) TEST MACHINE | DRY 5 GRADE<br>WET 4 GRADE | 5 GRADE<br>3-4 GRADE | 2-3 GRADES<br>1-2 GRADES |
| WASHING TEST ( JIS L0844 ) C-2 METHOD | DISCOLORING *1<br>4-5 GRADES<br>CONTAMINATION<br>5 GRADE SILK<br>5 GRADE COTTON | 5 GRADE *2<br><br>4-5 GRADES<br>5 GRADE | — |
| DRY CLEANING ( JIS L0 860 ) | DISCOLORING<br>5 GRADE<br>CONTAMINATION<br>3-4 GRADES RAYON | 5 GRADE<br><br>4-5 GRADES COTTON | — |
| HOT WATER TEST ( JIS L0845 ) | — | — | |
| WATER TEST ( JIS L0846 ) | — | — | |
| SWEAT TEST ( JIS L0848 ) | ( ACID )<br>DISCOLORING<br>5 GRADE<br>CONTAMINATION<br>4-5 GRADES SILK<br>4-5 GRADES COTTON<br>( ALKALINE )<br>DISCOLORING<br>5 GRADE<br>CONTAMINATION<br>4-5 GRADES SILK<br>4-5 GRADES COTTON | 5 GRADE<br>5 GRADE<br>5 GRADE<br>5 GRADE<br>4-5 GRADES<br>5 GRADES | 5 GRADE<br>5 GRADE<br>5 GRADE<br>5 GRADE<br>4 GRADE<br>5 GRADE |

FIG.12

*1 C-2 METHOD *2 C-1S METHOD

WOVEN OR KNIT FABRICS MANUFACTURED USING YARN DYED RAW SILK

This application is a divisional of application Ser. No. 08/836,971 filed on May 22, 1997 now U.S. Pat. No. 5,849,040 which is a 371 of PCT/JP96/01019, filed Apr. 12, 1996.

BACKGROUND OF THE INVENTION

1. Technical Field

The present invention relates to a process for manufacturing woven or knit fabrics using sericin fixed type yarn dyed raw silk and the woven or knit fabrics manufactured by the same process.

2. Related Art

Prior art yarn dyed silk woven fabrics have been manufactured from silk in which sericin or silk glue (about 25% of the total weight of raw silk) which covers the periphery of the raw silk fibers is removed and thereafter only fibroin is dyed (the same may be applied to the knit silk fabrics).

In order to twist yarn hard after sericin has been removed, it is generally carried out after conducting shrink proofing and twist setting for the silk yarns by using starch. However, manufacturing a great quantity of silk fabrics for Japanese and is expensive due to the Western clothes by this manufacturing process has encountered processing problems and cost of yarn twisting or fabric manufacturing. Thus, the fabrics manufactured by this process have been used in only a restricted field of high grade Japanese clothes, such as kimono. Such a traditional technology has a tendency to decline with the time due to problem in technical successors.

Due to these problems, few yarn dyed, hard twisted silk fabrics have been used. Piece dyed woven or knit fabrics have been predominantly used in silk fabrics. There is a restriction that shrink-proofing and twist setting of silk yarns can not be achieved unless almost 100% sericin is left in order to manufacture the fabrics using both wefts and warps of hard twisted yarns. Under this condition, the piece dyed fabrics are manufactured by following the steps as follows: (1) manufacturing of raw silk; (2) soaking and drying; (3) winding; (4) first twisting; (5) doubling and twisting; (6) final twisting and twist setting; (7) weaving or knitting; (8) scouring (degumming) at a plant; (9) dyeing products; (10)

The scouring at the plant is conducted at five steps as follows:

| | | |
|---|---|---|
| 1. | Preliminary scouring (alkali scouring) | 98° C., 320 minutes (5 hours 20 minutes) |
| 2. | Main scouring (alkali scouring) | 98° C., 600 minutes (10 hours) |
| 3. | Finishing scouring (alkali scouring) | 98° C., 60 minutes (one hour) |
| 4. | Drying finishing | |
| 5. | Tentering, softening finishing | |

It takes an extended time. In order to shorten the period of time taken for preliminary and main scouring steps, a high pressure scouring may be conducted. Since the fabrics are dyed after removal of sericin to produce the piece dyed fabrics, the finished fabrics have various problems which will be described hereafter.

These problems occur due to the dyeing method which is adopted to conduct the piece dyeing method. A prior art method of dyeing 100% silk fabrics having a large width will be briefly described with reference to FIG. 1. The prior art method which has previously been adopted as a method of dyeing fabrics having a large width is referred to as "suspend dyeing". An elongated and wide fabric 14 which is disposed in serpentine or spiral manner as shown in FIGS. 1(*b*) and 1(*c*), respectively is suspened from parallel or radial bars 10 with equal length threads 12 so that it is dipped into hot water and dye 16 in a dyeing tub 18 as shown in FIG. 1(*a*).

A first problem of the piece dyed fabric resides in that the upper side of the fabric 14 to which threads 12 are bound is dyed to a color different from that of the lower side thereof if the fabric 14 has a width of about 114 cm or more. The condition of the dyed fabric 14 is schematically illustrated in FIG. 2. The fabric 14 is actually extended in a transverse direction in FIG. 2. The upper portion 14*a* (from the upper side 14*c* of the fabric 14 to about 114 cm lower position) is dyed to a specified color although the lower portion 14*b* (from the about 114 cm position to the lower side 14*d* of the fabric 14) generally exhibits dense and light fading colors. It is estimated that this is due to the fact that the temperature of the hot water and mixing ratio of the dye 16 in the vicinity of the surface level in the tub 18 is delicately different from that in the vicinity of its bottom.

A second problem of the piece dyed fabrics is that defects such as creases, rub marks, and wrinkles may occur on the surface of the fabric 14. Since the fabric 14 is moved up and down and the water and dye 16 is heated with steam to about 100° C. during the dyeing process, the fabric 14 that is suspended only through threads 12 could be waved or the lower side 14*d* of the fabric 14 could be rolled up so that the above-mentioned defects occur. It is obvious that a rub mark 15*a* is formed in the vicinity of the center of the fabric 14, a wrinkle 15*b* is formed in the vicinity of a position to which a thread 12 is attached and a crease 15*c* is formed in the vicinity of the lower side 14*d* which is liable to be rolled up.

A third problem of the piece dyed fabrics is that creases 15*d* and wrinkles 15*e* occur in the vicinity of upper and lower sides 14*c*, 14*d* of the fabric 14 when the fabric 14 has a width of 114 cm or more (refer to FIG. 4). This is due to the fact that the center of the fabric 14 is loosened by the weight of the fabric and the water contained therein as represented by a two-dot-and-chain line in FIG. 4(*a*) since tentering to the fabric 14 is conducted in a wet condition during finishing treatment. If the loosened fabric 14 is tensioned as represented by a solid line in FIG. 4(*a*), an inward force acts against the outward tension so that the fabric 14 is not balanced. Thus, the creases 15*d* and wrinkles 14*c* may occur as shown in FIG. 4(*b*).

Due to the above-mentioned problems of the piece dyed fabrics, it has previously been very hard to piece-dye the silk fabric having a width of 150 cm. Accordingly, fabrics of a high yield rate having a width of 96 to 114 cm have been mainly manufactured so that defects such as crease, rub marks, wrinkles can be eliminated.

However, there have been demands for silk fabrics having a width of 150 cm for various reasons which will be described hereafter. Development for silk fabrics having a large width has been demanded.

A first reason why silk fabrics having a width of 150 cm are demanded is that a great cutting loss occurs if, for example, a double-breasted suit is produced from a piece dyed silk fabric having a width of 96 to 114 cm. The Japanese apparel sewing systems are currently on the top level in the world and are adapted to 150 cm width cloth. A great cutting loss of fabric occurs if one double-breasted suit is made from a fabric having a width of 96 to 114 cm.

Fabric loss during manufacture of a double breasted suit is calculated with reference to FIGS. 5 and 6. When a fabric having a width of 150 cm is used (FIG. 5), the fabric area needed is 4.5 $m^2$ (1.5 m x 3 m). When a fabric having a width of 114 cm is used (FIG. 6), the fabric area must be 5.7 $m^2$ (1.14 m x 5 m). Thus, in the manufacture of a double beasted suit, the use of fabric having 114 cm width, as compared to fabric having 150 cm width, results in fabric loss of about 1.2 $m^2$ . The cutting loss will be included in the original cost of the suit. References A to F in the drawing schematically denote cut pieces for making a double-breasted suit.

A second reason why the silk fabrics having a width of 150 cm are demanded is that demerits of cloths, if any, should be indicated by the Product Liability Law which was enforced in 1995 in Japan. Japanese apparel manufacturing (manufacturers of formal wear) use few silk fabrics that are made in Tango, Japan and deal with secondary products made in China (clothes which have been sewn) or Italian silk fabrics. The silk products that are made in China have problems in quality due to problems in manufacturing systems and its management. The Italian silk fabrics have a width of 130 cm, which are not suited for Japanese sewing systems similarly to the above-mentioned Japanese piece dyed silk fabrics having a width of 114 cm. This may also be included in the cost of silk clothes. Since Italian silk fabrics are not suspend-dyed as is done for Japanese silk fabrics, but are dyed by means of jiggers, sericin does not decompose sufficiently. Accordingly, Italian silk fabrics have an inferior color fastness. Indication of original manufacturing place and demerits is essential under enforcement of the Product Liability Law. The apparel industry has encountered big problems on these points.

For these reasons, the Japanese apparel industry has shifter from natural materials to composite materials and has a strong demand to have silk fabrics having a width of 150 cm of 100% silk made in Japan.

In such a manner, the piece dyed silk fabrics have various problems and could not have met the demands from the apparel industry.

SUMMARY OF THE INVENTION

The present invention aims to overcome the above-mentioned problems of the prior art and provides a process for manufacturing a woven or knit fabric using sericin fixed type yarn dyed silk fibers having a fibroin core and a sericin sheath comprising the steps of dyeing the sericin and fibroin to the same color, making yarn dyed silk by doubling and twisting the dyed silk fibers, making a cloth by weaving or knitting the yarn dyed silk fibers, swelling the yarn dyed silk fibers of the cloth by dipping the cloth into hot water, and decomposing the sericin by scouring the cloth with an enzyme in hot water.

In a second aspect of the present invention, there is provided a process for manufacturing a woven or knit fabric using yarn dyed silk fibers which further comprises a step of dyeing the cloth by dipping it into a dyeing tub after sericin has been decomposed at the enzyme scouring step.

In a preferred embodiment of the present invention, swelling may be promoted by adding a solvent such as sodium bicarbonate into the hot water at said swelling step and sericin of the swelled silk may be decomposed with an enzyme or bacteria at said enzyme scouring step.

In a further preferred embodiment of the present invention, the process further includes a finishing scouring step for removing the enzyme by washing the enzyme scoured cloth after the enzyme scouring step and softening treatment. Water repellent treatments may also be conducted simultaneously.

In a third aspect of the present invention, there is provided a woven or knit fabric that is manufactured by the process for manufacturing a woven or knit fabric using yarn dyed silk as defined above.

BRIEF DESCRIPTION OF THE DRAWINGS

FIG. 1(*a*) is a longitudinal sectional view showing the condition in which fabrics are dyed by a prior art suspend dyeing method in a dyeing tub;

FIGS. 1(*b*) and 1(*c*) are plan views, respectively showing the condition in which fabrics are dyed in a dyeing tub;

FIG. 11 is a table showing the comparison of characteristics between the prior art 100% silk fabric which was made by piece dyeing and woven or knit fabric using yarn dyed silk of the present invention; and FIG. 12 is a table showing the comparison of measuring results as set forth in a color fastness test report.

DESCRIPTION OF PREFERRED EMBODIMENTS

Now, a process for making a woven or knit fabric using sericin fixed type yarn dyed raw silk of the present invention and the woven or knit fabric which is made according to the process will be described in detail with reference to drawings.

Figure 1A:
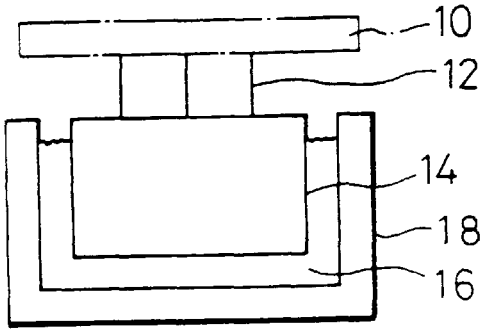
FIGS. 1(*a*) to 1(*c*) are views for explaining the prior art piece dyeing method.
Figure 1B:
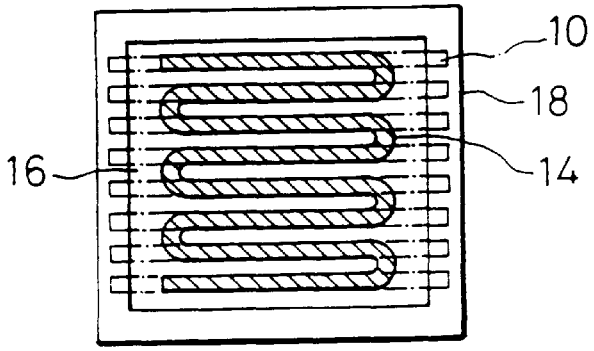
Figure 1C:
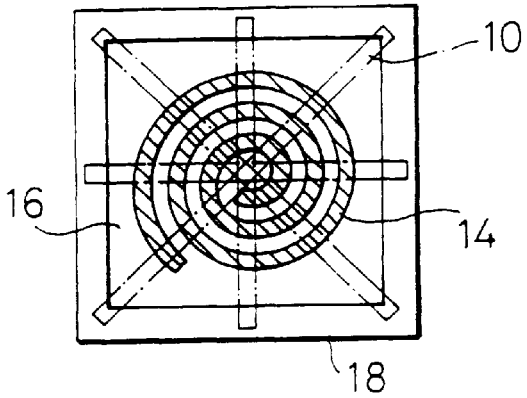
Figure 2:
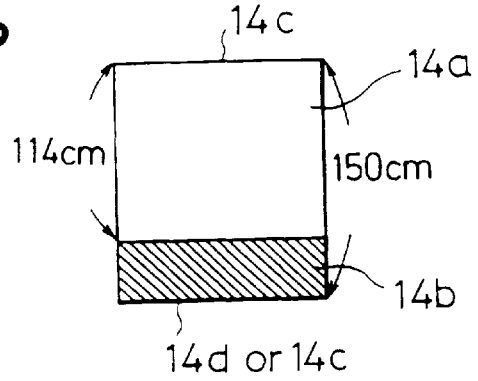
FIG. 2 is a front view showing a fabric which has been dyed by prior art piece dyeing method.
Figure 3:
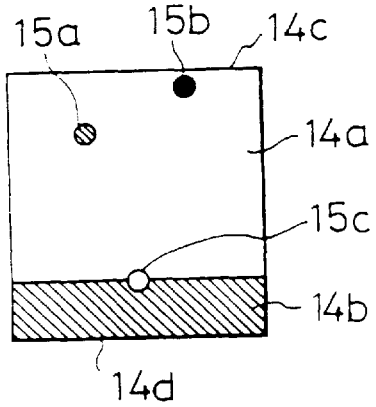
FIG. 3 is an explanatory view for explaining the positions of defects such as rub marks, wrinkles and creases which occur on the surface of fabric shown in FIG. 2.
Figure 4A:
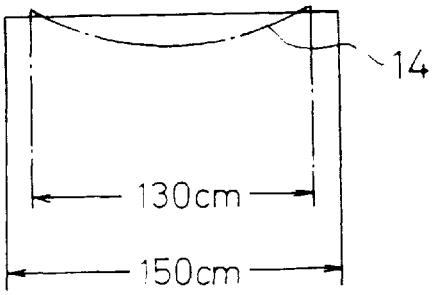
FIG. 4 is an explanatory view for explaining the positions of defects such as wrinkles and creases which occur on the surface of fabric of FIG. 2 when finishing is conducted on a tenter.
Figure 4B:
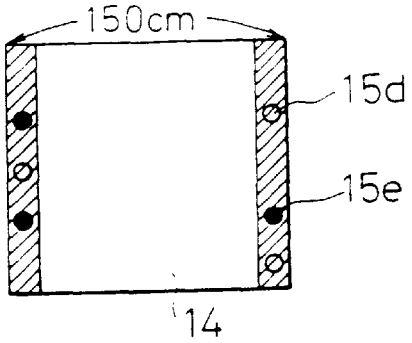
Figure 5:
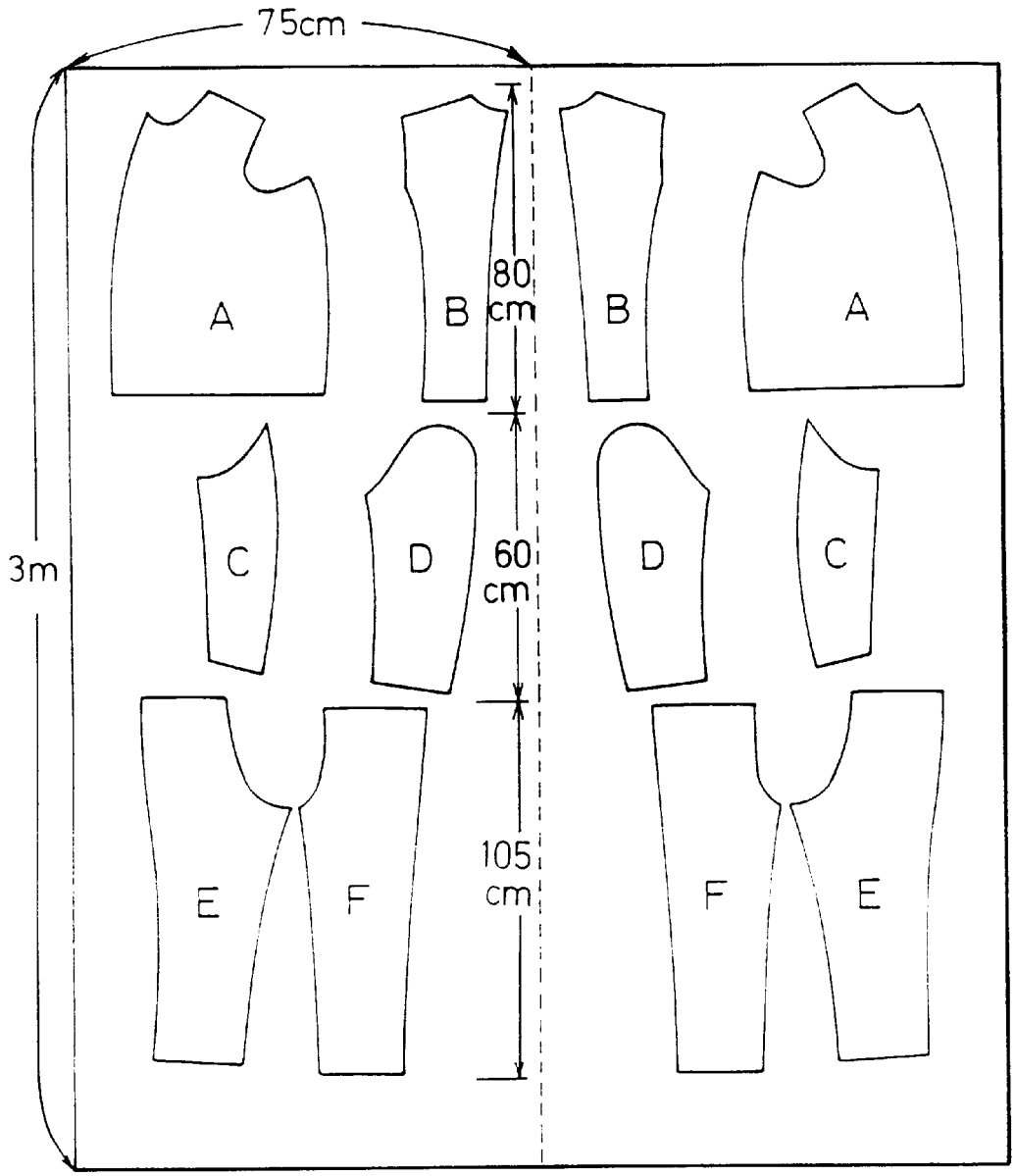
FIG. 5 is a plan view for explaining the cutting loss of fabric for making a double-breasted suit when the width of cloth is 150 cm.
Figure 6:
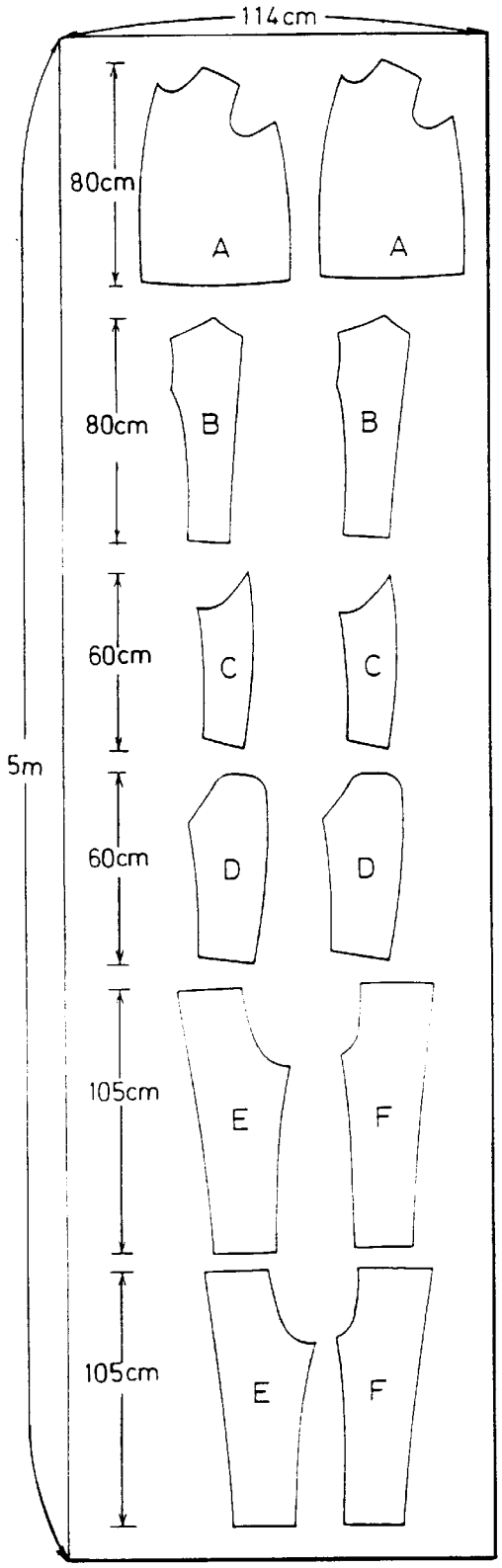
FIG. 6 is a plan view for explaining the cutting loss of fabrics for making a double-breasted suit when the width of cloth is 114 cm.
Figure 7:
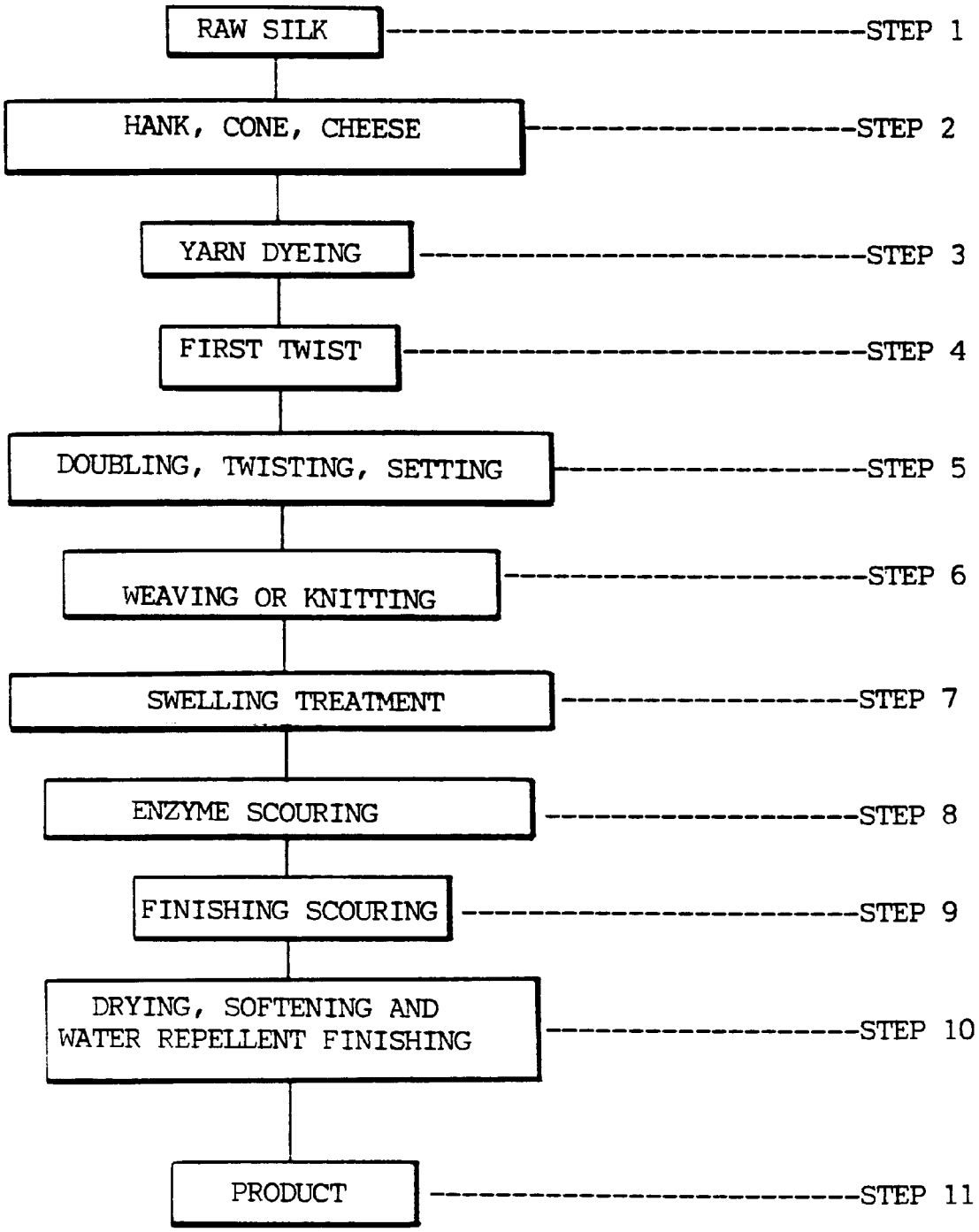
FIG. 7 is a flow chart showing one process for producing a woven or knit fabric using yarn dyed silk of the present invention.

Referring now to FIG. 7, there is shown a flow chart showing a process for making woven or knit fabric using sericin fixed type yarn dyed raw silk of the present invention.

Raw silk is prepared similarly to prior art (step 1). The silk is reeled in the form of hank, cone or cheese (step 2). The reeling is dipped in a dyeing bath so that sericin and fibroin are dyed into the same color while sericin is fixed to the fibroin (step 3). In this specification, this type of raw silk is referred to as "sericin fixed type yarn dyed raw silk" or simply as "yarn dyed silk". Thereafter, first twisting is conducted on the dyed silk. Twist setting is conducted by doubling and twisting in case of cheese or cone (step 5) or by winding first and then by doubling and twisting in case of hank. Various known methods such as single twisting, plying (folding) and special twisting can be adopted to provide various yarns having different fineness and characteristics. Yarn dyed jacquard fabrics can be obtained since warps and wefts can be hard twisted yarns in such a manner. If the yarn dyed silk is hard twisted yarn, such twisted yarn (single twisted yarn; S, Z) has a strong recovery force. Fabrics which are made from this yarn are resistant to wrinkling and can be provided with stretching properties.

Woven or knit fabrics are produced by weaving or knitting machines, respectively, using such hard twisted yarn dyed silk (step 6). Since weaving or knitting is conducted using yarn dyed silk, no dyeing step which was otherwise conducted in the prior art is necessary after the cloth has been made. Accordingly, there is no likelihood that defects such as color shadings (dyeing specks), rub marks, wrinkles and creases occur due to the above-mentioned dyeing. It is possible to make high quality cloths having a width of 150 cm. Provision of cloth having a width of 150 cm or any width is preferable for the apparel sewing and making systems existing in Japan and sewing becomes easier. Since cutting loss of the cloth having a width of 150 cm is less than that having a width of 114 cm as mentioned above, there is an advantage that the cost of the product made from such wide cloth can be reduced.

It is known that sericin can not be decomposed as the prior art piece dyed fabrics even if thus woven or knit cloth is scoured with soap alkali. Hence, the woven or knit cloth is dipped in sodium bicarbonate (hot water in which a solvent such as RASEN POWER I, II is dissolved) and is swelled so that the volume of the yarns is increased (step 7) and then the cloth is treated with a sericin decomposable enzyme such as ALCALASE and SERLASE to remove sericin (step 8). Thereafter, the cloth which has been scoured with an enzyme is washed in a hot water tub to remove the enzyme and finishing scouring is conducted (step 9).

At the swelling step, under a high pressure using a high pressure pot, the temperature of the hot water can be elevated to 100° C. or higher. This shortens the period of time for completing the swelling step. It is preferably that the period of time for the swelling step be 60 to 120 minutes when high pressure pots of 110° C. at 2 atmospheric pressure are used and 120 to 180 minutes when high pressure pots of 98° C. at one atmospheric pressure are used. The enzyme scouring is preferably conducted at 60° C. or less to maximize the effect of the enzyme. It takes about 60 to 80 minutes to complete the enzyme scouring. If the temperature is elevated above 60° C., enzyme or bacteria the unique effect of the present invention that is decomposition of sericin can not be performed. It is preferable to conduct finishing scouring at relatively high temperatures of about 100° C. The period of time taken to complete the finishing scouring is about 60 minutes.

Then, various finishing treatments such as drying, tentering, softening and water repellent finishing are conducted if needed (step 10) to provide a silk fabric that is a finished product (step 11). Drying can be conducted by using a 120° C. heated air and a cylinder having a surface temperature of 120° C. Since the water repellent finishing is a process for providing the fabrics with a water repellent ability and is accompanied by additional cost in the prior art method, it is conducted for only special application. For this reason, wearing of a silk product on a rainy day is considered prohibitive in the prior art.

Figure 10:
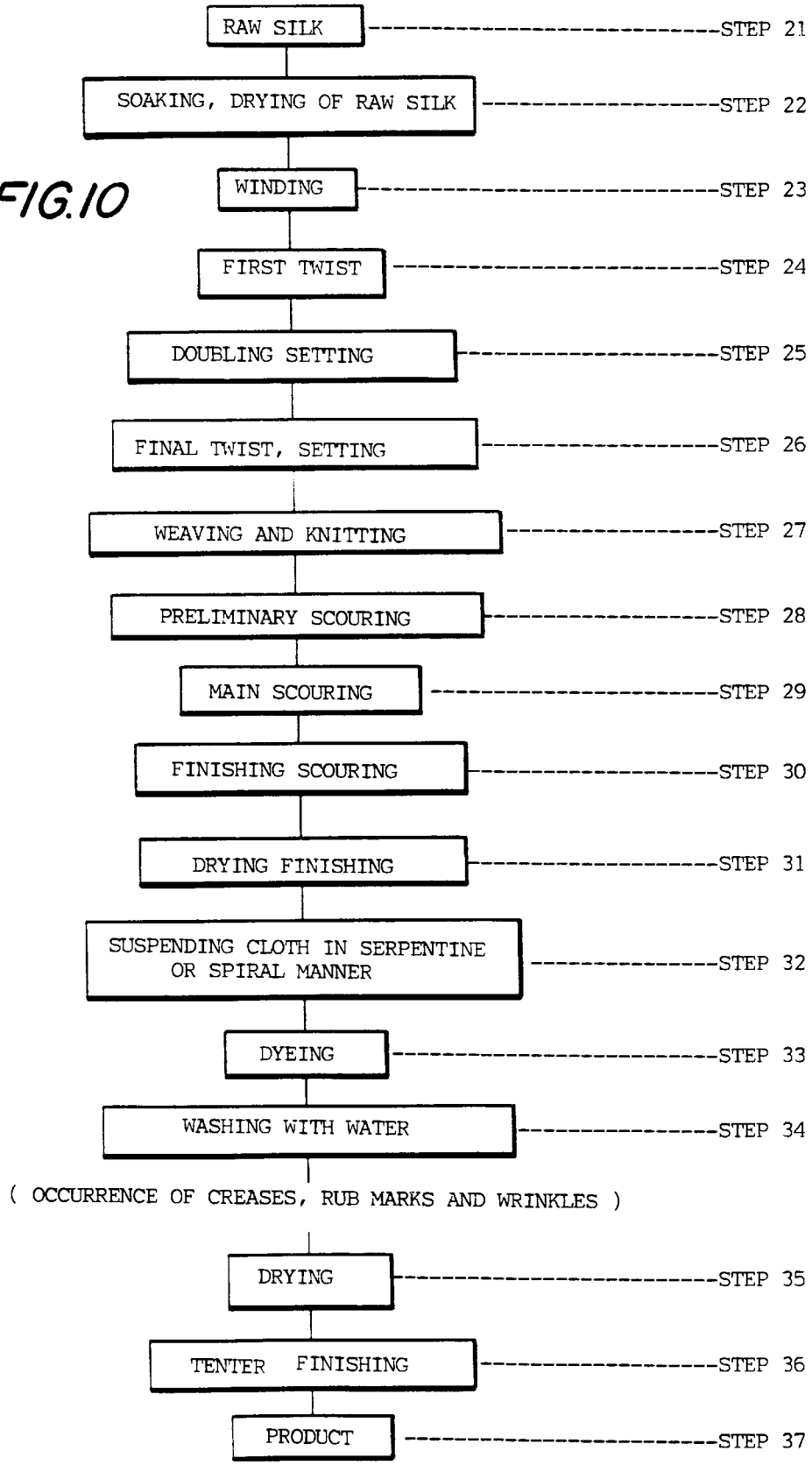
FIG. 10 is a flow chart showing a process for producing a prior art piece dyed fabric.

Referring now to FIG. 10, there is shown a flow chart showing a process for manufacturing the above-mentioned prior art piece dyed silk woven or knit fabric. Comparison of the inventive process to the prior art process shows that the present invention is totally different from the prior art in order or timing of dyeing and sericin decomposition, or step of decomposing sericin after weaving or knitting. Due to these differences, the present invention provides various distinct effects which will be described hereafter.

It is to be particularly noted in FIG. 10 that although drying finishing is conducted at step 31, water repellent treatment can not be conducted at this step in the prior art piece dyeing method since water is repelled. Water repellent treatment cannot also be conducted during tenter finishing at step 36. The reason is that drying, water repellent and softening finishing are integral to each other and that tenter finishing cannot constantly dry the cloth if it contains some solvent for these finishing or water.

Accordingly, the width of the cloth is narrowed at a dyeing step and the cloth should be finished to provide a larger width than that of the dried cloth. Since the cloth cannot be stretched in a traverse direction (tentered) in drying finishing, treatments of drying, water repellent and softening are simultaneously conducted without stretching the cloth. If the water repellent treatment is conducted in a piece dyeing method at this time, drying finishing should be conducted again. However, once the cloth is dipped in water and solvent, the cloth (which is dried by tenter finishing) is returned to the original condition so that the cloth does become uneven. This is why the water repellent treatment can not be conducted and is a drawback of the prior art piece dyeing method.

It was confirmed from an experiment that the dyed sericin was not decomposed although preliminary scouring and main scouring were conducted for 600 minutes (10 hours), respectively for fabrics comprising wefts and warps of yarn dyed silk according to prior art scouring method for decomposing sericin as mentioned above. The cloth was brought into contact with each other at the scouring step so that rub marks are formed thereon. The resultant cloth could not be used as high grade cloth for Japanese and Western clothes.

If the woven or knit fabric using yarn dyed silk in which either or both of wefts and warps are hard twisted yarns is scoured in a hot water having a temperature of 98° C. to 100° C., the yarn is contracted in a length direction and the wefts and warps are contacted with each other with a strong force at intersection positions of the wefts and warps. This means that the sericin is secured more strongly to the fibroin than natural silk so that sericin cannot be decomposed by usual soap alkali scouring.

We conclude that the decomposition of sericin of the yarn dyed silk is impossible by the above-mentioned usual scouring method that is conducted for piece dyed fabric. The features of the present invention reside in that sericin is made readily decomposable by enzyme after subjecting the cloth produced by weaving or knitting yarn dyed silk to a swelling treatment, so that no damage is given to the torque of the yarn dyed silk and textile woven. This results in that characteristics which are inherent in the yarn dyed silk can be developed. The period of time of the swelling step and enzyme scouring step is determined depending upon, the fineness of silk, the number of twists of the twisted yarn, textile and difference in cloths.

Therefore, the woven or knit fabric that is produced by the process of the present invention is totally different from the piece dyed fabric. The differences will now be described in detail.

Most of the 100% silk fabric has previously been a piece dyed fabrics (width of 38 to 114 cm) due to problems of fabrication technology, weaving plan, and finishing arrangement and scouring as mentioned above. However, use of yarn dyed silk according to the present invention makes it possible to conduct doubling and twisting while sericin is fixed, so that it is possible to produce woven or knit fabrics in which the problems at dyeing step are overcome. New type of woven or knit fabrics having luster peculiar in silk and which are added with new characteristics such as wrinkly resistance, stretch ability and water repellent ability can be provided by using hard twisted yarns.

Although water repellent treatment for Japanese clothes has been compensated for by various treatments, the present invention provides a water repellent treatment at final finishing step.

A second aspect of the present invention is characterized in that the step 8 at which sericin is removed by treating it with a sericin decomposable enzyme such as ALCALASE, SERLASE or step 9 in FIG. 7 at which finishing scouring is conducted by washing the enzyme scoured cloth in a hot tub to remove the enzyme and is followed by an additional piece dyeing step at which the cloth is dipped in a dyeing tub to conduct piece dyeing.

Black piece dyed cloth of 100% silk generally has a very low color fastness so that indication of demerit condition is compelled by Product Liability Law. Fabrics for Japanese clothes are made by weaving or knitting raw silk and then sericin is removed by scouring treatment to make the color of the fabrics white. Then piece dyeing treatment is conducted. This may deteriorate the color fastness. Accordingly, prior art silk woven or knit fabrics that are dense color are inferior in color fastness and the fabrics used for inner lining are mainly dyed to light colors to avoid discoloring due to washing or dry cleaning and color changes due to sweat.

In the present invention, woven or knit fabric is produced by weaving or knitting yarn dyed silk and sericin is decomposed by subjecting the woven or knit fabric to swelling and enzyme scouring steps. In this condition, the woven or knit fabric has been already yarn-dyed into black, dense or light color. If the over-dyeing, or piece dyeing of the fabric is conducted, a deep color which is different from that of the original woven or knit fabric is exhibited and the color fastness is enhanced. This provides novel cloths for Japanese clothes.

FIG. 11 is a table in which the characteristics of prior art piece dyed 100% silk fabric are compared to those of the woven or knit fabric using yarn dyed silk of the present invention.

Now, composite fabrics which are made from a composite with other fibers will be described.

Combination fabrics of silk with wool have a great deal of demand as coat materials. Combination fabrics of silk with the other fibers such as wool have been hardly produced due to problems of dyeing. Since sericin can not be decomposed by a prior art method after the fabrics are made by weaving or knitting the yarn dyed silk as mentioned above, composite fabrics including silk had to be piece dyed. An alkali solvent is necessary to decompose sericin of silk when silk is combined with wool, but the solvent causes wool to deteriorate. If composite fabric of silk with wool is dyed to a black color, silk is dyed to light black while wool is dyed to dark black. This chambray condition will not change even if dyeing is repeated many times. This is due to the fact that silk and wool have different dye setting speeds and dye penetration degrees although they both are animal fibers. This problem can not be solved by the piece dyeing method.

Since sericin of silk can be decomposed with an enzyme after weaving or knitting the yarns by the process of the present invention even if the silk has been yarn dyed, the yarn dyed silk can be used as yarn for composite fabrics. This will be described in connection with the above-mentioned case. Fabrics are made by weaving or knitting the silk and wool that has been yarn dyed to black, and then sericin of the yarn dyed silk is removed. Thus, composite fabric of black silk with black wool having the same color tone is completed. In order words, the process of the present invention enables the development of composite solid color dyed (same color) fabrics of silk and wool. New materials for coats can be provided.

Now, knit fabric or Raschel fabric of 100% silk will be described.

The 100% silk knit Raschel fabric has previously been made from mainly spun silk. This is due to the fact that the value of commercial good can not be increased since the silk can be dyed to only one color even if expensive silk is used. Use of spun silk will lower the color fastness. This may lower the value of commercial good.

Since yarn dyed silk can be used by the process of the present invention, new type knit fabrics such as knit Jacquard fabrics that are made from yarn dyed silk (which is naturally not spun silk) having 2 or 3 different colors can be provided.

The prior art yarn dyeing has a disadvantage that the characteristics of woven or knit fabrics are very poor since they are made by weaving or knitting after sericin of yarns are removed. The only way to improve such characteristics is to use two folded yarns. Such a technique can not eliminate defects such as rub marks, wrinkles and creases on the completed fabric. Repair of the fabrics is impossible.

Various techniques such as use of two folded yarns or use of hard twisted yarns as weft can be adopted since the yarn dyed silk that is used for weaving or knitting has sericin fixed thereto. Setting characteristics of the yarns are excellent. If the rate of defect occurrence shall be minimized at the sericin decomposing step, fabrics having no defects can be made.

EXAMPLE 1

Figure 8:
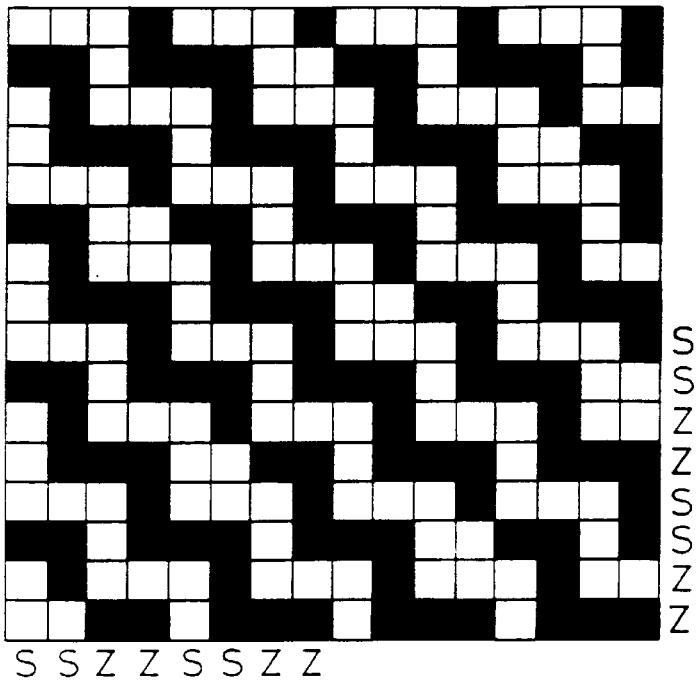
FIG. 8 is a schematic view showing the design of W georgette which is a fabric of Example 1.

Six yarns of 21 denier silk were doubled. Hank yarn dyeing into black color was conducted. Thereafter hard twisted yarns were made by twisting the yarns. The resultant hard twisted yarns are of 125 denier; 21D/6 (125 denier); S twist and Z twist; 2000 t/m. The yarn dyed silk was used according to specifications as follows:

| | |
|---|---|
| Total number of warps | 8880 |
| Total number of yarns in selvage | 8760 |
| Warping length | 63 m |
| Reed space | 74 inches |
| Number of dents per unit | |
| Length | 30 dents(4 reeds)/inch |
| Perchers | 100/inch |
| Textile view | (W Georgette/refer to FIG. 8) |

According to this specification, two doubled yarns (each is 21D/6 yarns, S twist yarn of 2000 t/m, A twist yarn of 2000 t/m were alternatively warped and were loaded in the following machine:

| | |
|---|---|
| A weaving machine; | PICANOL GTM |
| The number of rotations; | 340 r.p.m. |

Similarly, as defined in textile of W georgette, two doubled yarns (each is 21D/6 yarns, S twist yarn of 2000 t/m, Z twist yarn of 2000 t/m) were alternatively loaded as wefts.

Thus, woven fabric for western clothes was scoured (degummed) in a scouring plant as follows:

| | | |
|---|---|---|
| 1. | Swelling treatment (RASEN POWER I, II) | high pressure pot 110° C., 180 minutes |
| 2. | Enzyme scouring (SERIASE) | 55° C., 180 min. |
| 3. | Finishing scouring | cold pot 98° C., 60 min. |
| 4. | Drying, Softening and repellent treatment | hot air drying 120 min. Tenter finishing |
| 5. | Completion of fabrics | |

The finished fabric had a width of 150 cm and a weight of 219 g/m$^2$ or METSUKE 51 monme. The result of measurements set forth in a test report of color fastness dated Dec. 26, 1995 that was prepared by Kyoto-fu Orimono Shidosho (Aza Tanba, Mineyama-machi, Naka-gun, Kyoto-fu/Tetsu Kobayashi in charge of Test) are described in FIG. 12.

It is found from the measurement result that the fabric of Example 1 is 8 grade of discoloring (color fade) in a carbon ark light exposure test. The color fastness is remarkably enhanced in comparison to 3 to 4 grade of prior art piece dyed black silk fabric. Abrasion test shows that the fabric of Example 1 is 5 and 4 grades in dried and wet conditions, respectively. In comparison to that the prior art piece dyed black silk fabric is 2 to 3 grade and 1 to 2 grade in dried and wet conditions, respectively. It is found that the properties are also improved in this respect.

There is no comparative data on the color fastness since the prior art silk fabric that was piece dyed to black color can not be subjected to both washing and dry cleaning. However, the fabric of Example 1 has a discoloring of 4 to 5 and 5 grade and has a contamination of 5 grade (silk and cotton) and 3 to 4 grade (rayon) in washing test and dry cleaning test, respectively. It is suggested that the fabric of Example 1 can be used as fabric for western clothes.

Sweat test A shows that the fabric of Example 1 exhibits characteristics which are substantially equivalent to those of prior art silk fabric which has been piece dyed to black color in both acid and alkali tests.

EXAMPLE 2

Six SILK yarns of 21 denier was doubled and wound into a cheese. Cheese dyeing into black color was conducted. Thereafter hard twisted yarns were made by twisting six yarns. The resultant hard twisted yarns are of 125 denier 21D/6 (125 denier); S twist and Z twist; 200 t/m. The yarn dyed silk was used according to specifications as follows:

| | |
|---|---|
| Total number of warps | 7920 |
| Total number of yarns in selvage | 7800 |

-continued

Figure 9:
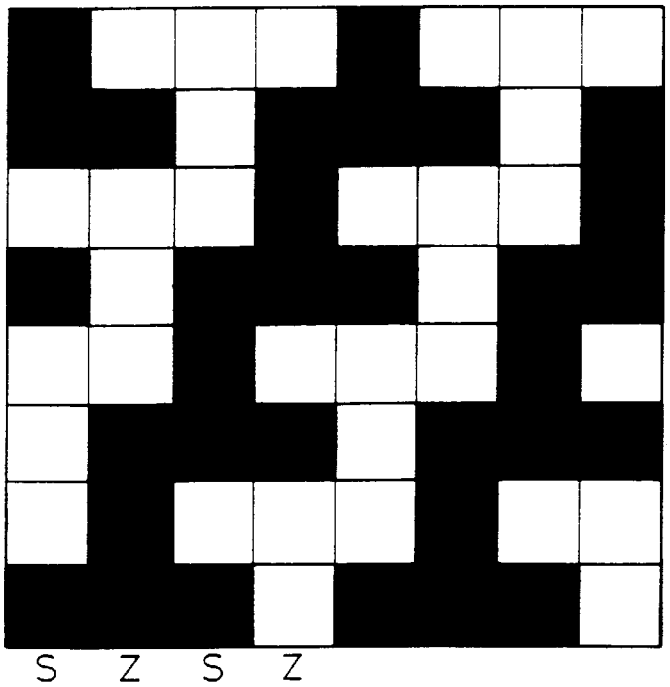
FIG. 9 is a schematic view showing the design of W crepe which is a fabric of Example 2.

| | |
|---|---|
| Warping length | 63 m |
| Reed space | 66 inches |
| Number of dents per unit | |
| Length | 30 dents/inch(4 reeds) |
| Percher | 86/inch |
| Textile view | (W Georgette/refer to FIG. 9) |

According to this specification, one doubled yarn (each is 21D/6 yarns, S twist yarn of 1250 t/m, Z twist yarn of 1250 t/m) were alternatively warped and were loaded in the following machine:

| | |
|---|---|
| A weaving machine; | VERSAMAT HOWA KOGYO |
| The number of rotations; | 200 r.p.m. |

Similarly, as defined in textile design of W georgette, one yarn of S twist and Z twist (each is 21D/6 yarns and is of 1250 t/m) was alternatively loaded as wefts.

Thus, woven fabric for western clothes was scoured in a scouring plant as follows:

| | | |
|---|---|---|
| 1. | Swelling treatment | cold pot 98° C., 120 minutes |
| 2. | Enzyme scouring | 55° C., 120 min. |
| 3. | Finishing scouring | cold pot 98° C., 60 min. |
| 4. | Drying | cylinder drying (surface temperature 120° C.) |
| 5. | Softening and repellent treatment | Tenter finishing |
| 6. | Completion of fabrics | |

The finished fabric had a width of 150 cm and a weight of 122.2 g/m$^2$ or METSUKE 28.5 monme. The result of measurements set forth in a test report of color fastness dated Nov. 24, 1995 that was prepared by Kyoto-fu Orimono Shidosho (Aza Tanba, Mineyama-machi, Naka-gun, Kyoto-fu/Tetsu Kobayashi in charge of Test) are set forth in FIG. 12.

Various characteristics of the fabric of Example 2 are substantially equal to those of the fabric of Example 1.

EXAMPLE 3

Hard twisted yarn of 126 denier that is spun from 6 yarn dyed silks of 21 denier and then is hard twisted (S twist yarn of 2000 t/m, Z twist yarn of 2000 t/m) having the same specifications of Example 1 was used. The yarn dyed silk was rolled on 20 cones. FUKUHARA WS knitting machine (single knit) knitted the yarn dyed silk at 28 rotations per minute with providing S and Z twist yarns alternatively.

The knit fabric had a width of 191 cm and was scoured at a plant according to the steps as follows:

| | | |
|---|---|---|
| 1. | Swelling treatment cold pot | 98° C., 120 minutes |
| 2. | Enzyme scouring | 55° C., 120 min. |
| 3. | Water repellent and softening treatment | |
| 4. | Complement of knit fabric (width 160 cm) | |

The fabrics produced had characteristics which have not been obtained by the prior art, as will be described hereafter.

Since the fabric using the above-mentioned prior art yarn dyed silk is produced by knitting the silk that was dyed after sericin has been removed, this prior art yarn dyed silk can not be hard twisted yarn so that only transverse stretching properties were obtained.

The fabric of Example 3 has longitudinal stretching properties due to the elasticity (torque) which the yarn dyed silk possesses. This fabric can be used as cloth for western clothes that are cut for current three-dimensional sewing and inner lining owing to these longitudinal stretching properties. A new application field for knit fabrics can be developed. The recovery ability, which is exhibited after stretching is also enhanced in comparison to the fabrics using prior art yarn dyed silk or raw silk.

Dyeing, appearance and texture of the silk woven or knit fabric can be achieved at a high quality in Examples 1 to 3 since the yarn dyed silk according to the present invention, wherein both sericin and fibroin are dyed to the same color while sericin is fixed to the fibroin, is woven or knitted, and thereafter sericin can be decomposed at swelling and enzyme scouring steps.

The prior art 100% silk piece dyed woven or knit fabrics are very inferior in color fastness as both fabrics for kimono and western clothes. Accordingly, wearing of silk kimono or western clothes has been considered prohibitive. The results of carbon are light test, abrasive test, washing test and dry cleaning test of the fabrics of Examples 1 and 2 turn over the common sense of prior art piece dyed fabrics.

In accordance with the present invention, a process for manufacturing a woven or knit fabric using yarn dyed silk, comprises the steps of dyeing sericin which covers the periphery of silk fibers and fibroin which is located inside thereof into the same color; making yarn dyed silk by doubling and twisting the dyed silk fibers; making a cloth by weaving or knitting the yarn dyed silk; swelling the yarn dyed silk which constitutes the cloth by dipping the cloth into hot water in a tub; and decomposing sericin of the yarn dyed silk of the cloth with an enzyme in hot water in a tub.

Accordingly, defects such as color shading, rub mark, wrinkle and crease due to piece dyeing are prevented from occurring. The color fastness is remarkably enhanced in comparison to that obtained by the piece dyeing method. The manufacturing of high quality fabrics having a large width of 150 cm or any width which can meet the requirements of Product Liability Law is made possible. Further, the fabrics having an excellent water repellency can be manufactured.

In a second aspect of the process of the present invention, the process further includes a piece dyeing step at which the fabric is dipped in a dyeing tub after the enzyme scouring step. Accordingly, new fabrics for Japanese and Western clothes, which exhibit a deep color different from that of the yarn dyed fabric and have an excellent color fastness can be manufactured.

Since the silk fabrics that are provided in a third aspect of the present invention have a large width of 150 cm, they are suited for existing apparel sewing systems in Japan so that sewing of the fabrics is made easier. Use of yarn dyed silk as hard twisted yarns makes it possible to provide new type fabrics having glazing uniquely possessed by silk and which are added with new characteristics such as wrinkle resistance and stretch properties in both transverse and longitudinal directions.

Therefore, the industrial utilization of the present invention is very high.

What is claimed is:

1. A woven or knit silk fabric comprising doubled and twisted dyed silk fibers having a like dyed fibroin core and sericin sheath, wherein said sericin sheath has been decomposed through swelling and enzyme decomposition after weaving or knitting.

2. The woven or knit silk fabric according to claim 1, wherein said fabric has a discoloring property that falls within the 8th grade under CARBON ARC LIGHT TEST defined in JIS L0842.

3. The woven or knit silk fabric according to claim 2, wherein said fabric has a width of at least 150 cm.

4. The woven or knit silk fabric according to claim 1, wherein said fabric has an abrasion property that falls within the 5th grade and ranges from the 3rd to the 4th grades under ABRASION TEST in DRY and WET conditions defined in JIS L0849, respectively.

5. The woven or knit silk fabric according to claim 4, wherein said fabric has a discoloring property that falls within the 8th grade under CARBON ARC LIGHT TEST defined in JIS L0842.

6. The woven or knit silk fabric according to claim 1, wherein said fabric has a washing property that, for DISCOLORING, ranges from the 4th to the 5th grades under WASHING TEST defined in JIS L0844 of C-2 method or falls within the 5th grade under WASHING TEST defined in JIS L0844 of C-1S method, and, for CONTAMINATION ranges from the 4th to the 5th grades SILK and falls within the 5th grade COTTON, respectively.

7. The woven or knit silk fabric according to claim 6, wherein said fabric further has an abrasion property that falls within the 5th grade and ranges from the 3rd to the 4th grades under ABRASION TEST defined in JIS L0849, respectively.

8. The woven or knit silk fabric according to claim 7, wherein said fabric has a discoloring property that falls within the 8th grade under CARBON ARC LIGHT TEST defined in JIS L0842.

9. The woven or knit silk fabric according to claim 6, wherein said fabric has a discoloring property that falls within the 8th grade under CARBON ARC LIGHT TEST defined in JIS L0842.

10. The woven or knit silk fabric according to claim 1, wherein said doubled and twisted dyed silk fibers are dyed into two or more colors.

11. The woven or knit silk fabric according to claim 1, wherein said fabric is water repellent.

12. A woven silk fabric comprising doubled and twisted dyed silk fibers having a like dyed fibroin core and sericin sheath, wherein said sericin sheath has been decomposed through swelling and enzyme decomposition after weaving, wherein said fabric has a width of at least 150 cm.

13. The woven silk fabric according to claim 12, wherein said fibroin core and said sericin sheath are dyed black.

14. The woven silk fabric according to claim 13, wherein said fabric was overdyed with another dye or the same black dye.

15. The woven silk fabric according to claim 12, wherein said fabric has wefts and warps each comprising said doubled and twisted dyed silk fibers.

16. The woven silk fabric according to claim 12, wherein said fabric is jacquard and has wefts and warps each comprising hard twisted dyed silk fibers.

17. The woven silk fabric according to claim 12, wherein said fabric is a composite of silk and wool having has wefts comprising said doubled and twisted dyed silk fibers and warps comprising wool fibers.

18. The woven silk fabric according to claim 12, wherein said fabric is a composite of silk and wool having has warps comprising said doubled and twisted dyed silk fibers and wefts comprising wool fibers.

19. The woven silk fabric according to claim 12, wherein said doubled and twisted dyed silk fibers are dyed into two or more colors.

20. The woven silk fabric according to claim 12, wherein said doubled and twisted dyed silk fibers are two folded type fibers.

21. A knit silk fabric comprising doubled and twisted yarn dyed silk (not spun) fibers having a like dyed fibroin core and sericin sheath wherein said sericin sheath, wherein said sericin sheath has been decomposed through swelling and enzyme decomposition after knitting, wherein said fabric has a width of 150 cm or more.

22. The knit silk fabric according to claim 21, wherein said fabric is jacquard and said doubled and twisted dyed silk fibers are dyed into two or more colors.

23. The knit silk fabric according to claim 21, wherein said doubled and twisted dyed silk fibers are two folded type fibers.

24. The knit silk fabric according to claim 21, wherein said fibroin core and said sericin sheath are dyed black.

25. The knit silk fabric according to claim 24, wherein said fabric was overdyed with another dye or the same black dye.

* * * * *